US006497235B2

(12) United States Patent
Dorsa et al.

(10) Patent No.: US 6,497,235 B2
(45) Date of Patent: Dec. 24, 2002

(54) DISPENSER FOR COSMETIC MATERIAL OR THE LIKE

(75) Inventors: Salvatore Dorsa, East Northport, NY (US); Volker Schrepf, East Islip, NY (US)

(73) Assignee: Henlopen Manufacturing Co., Inc., Melville, NY (US)

( * ) Notice: Subject to any disclaimer, the term of this patent is extended or adjusted under 35 U.S.C. 154(b) by 0 days.

(21) Appl. No.: 09/825,394

(22) Filed: Apr. 3, 2001

(65) Prior Publication Data

US 2002/0020425 A1 Feb. 21, 2002

Related U.S. Application Data

(60) Provisional application No. 60/196,405, filed on Apr. 12, 2000.

(51) Int. Cl.[7] ..... A45D 40/26; A45D 40/24; A46B 11/00

(52) U.S. Cl. ..... 132/218; 132/317; 132/320; 401/126; 401/129

(58) Field of Search ..... 132/317, 320, 132/218, 112, 123, 219; 401/129, 282, 284, 122, 126, 127, 37, 38, 39; 15/105, 184, 185

(56) References Cited

U.S. PATENT DOCUMENTS

| | | | | | |
|---|---|---|---|---|---|
| 2,399,660 | A | * | 5/1946 | Boulicault | 132/218 |
| 2,666,222 | A | * | 1/1954 | Gordon | 132/320 |
| 2,829,655 | A | * | 4/1958 | Bau | 132/218 |
| 3,071,143 | A | * | 1/1963 | Bau | 132/218 |
| 3,073,320 | A | * | 1/1963 | Seaver | 132/320 |
| 3,921,650 | A | * | 11/1975 | Montgomery | 132/218 |
| 4,428,388 | A | * | 1/1984 | Cassai et al. | 132/218 |
| 5,137,038 | A | * | 8/1992 | Kingsford | 132/218 |
| 5,188,131 | A | * | 2/1993 | Toll | 132/218 |
| 5,970,990 | A | * | 10/1999 | Dunton et al. | 132/218 |
| 6,145,514 | A | * | 11/2000 | Clay | 132/218 |

* cited by examiner

*Primary Examiner*—Nicholas D. Lucchesi
*Assistant Examiner*—Robyn Kieu Doan
(74) *Attorney, Agent, or Firm*—Cooper & Dunham LLP

(57) ABSTRACT

A mascara dispenser including a container, a cap bearing a mascara brush, a comb retractable within the cap, and an element on the cap pivotally connected to a shaft that projects from the comb lengthwise within the cap. As the element is moved to extend the comb out of the cap, a guide within the cap engages a dogleg portion of the shaft to pivot the comb into an offset position relative to the dispenser, for ease of manipulation and use.

14 Claims, 3 Drawing Sheets

DISPENSER FOR COSMETIC MATERIAL OR THE LIKE

CROSS REFERENCE TO RELATED APPLICATION

This application claims the priority benefit, under 35 U.S.C. §119(e), of applicants' U.S. Provisional Application No. 60/196,405, filed Apr. 12, 2000, the disclosure of which is incorporated herein in its entirety by this reference.

BACKGROUND OF THE INVENTION

This invention relates to dispensers for materials that are applied manually to a substrate, such as, for example, cosmetics that are applied to a portion or feature of a user's face, and to cap and applicator units for such dispensers. In one important specific aspect, to which detailed reference will be made for purposes of illustration, the invention is particularly directed to dispensers for mascara, as well as to mascara packages.

In current commercial practice, mascara is commonly packaged in a small dispenser constituted of a container having a neck and a cap threadedly or otherwise removably mounted on the neck, the dispenser being dimensioned to be held in a user's hand and to be easily carried in a small purse. Typical configurations for such a dispenser include an elongated cylinder, in which the container and the cap each occupies about half the length of the external surface, or a similarly proportioned structure having a more or less square cross-section, although various other designs are also employed. The container and cap are conveniently rigid molded plastic or formed metallic members.

The cap of such a dispenser is provided with an applicator for picking up mascara from the interior of the container and transporting the mascara to and depositing it on the user's eyelashes. One well known type of applicator for mascara is a brush including an array of relatively stiff nylon or like bristles gripped at their midpoints in a twisted wire core, which is itself mounted at the free distal end of a molded plastic stem projecting distally from the cap so that when the cap is seated on the container neck, the brush extends into the interior of the container. A flexible annular plastic wiper element may be mounted in the neck to engage, and remove excess mascara from, the brush as the brush is withdrawn from the container. In a structure of this type, the cap serves both as a closure for the container and as a handle for the brush.

While applicators such as the described brush satisfactorily deliver mascara to and deposit mascara on eyelashes, the application of mascara may cause adjacent lashes to adhere together, detracting from their desired appearance. To correct this condition, a small lash-separating comb may be employed by the user immediately after the mascara is applied. Such a comb may be provided and carried separately, or may be a disposable item included in the mascara package by the manufacturer, but in either event, it presents problems of storage and shielding, and is liable to become lost or misplaced, hence unavailable when needed.

In addition, owing to the necessarily very small size of the comb (proportioned to engage and separate eyelashes), the handle or other arrangement for manually holding and moving the comb must be such as to enable safe and successful performance of the delicate manipulations involved in its use.

Similar problems may be encountered, for instance, in the case of other cosmetics (or topically applicable therapeutic materials) as to which both a primary applicator and a secondary implement to assist in the application procedure are desirably provided.

SUMMARY OF THE INVENTION

An object of the present invention is to provide a dispenser for a material to be applied manually to a substrate utilizing a primary applicator and a secondary implement to assist in the application procedure, wherein both the primary applicator and the secondary implement are carried in a cap element of the dispenser and are available for use without detachment therefrom, while being enclosed and shielded at other times.

A further object is to provide such a dispenser wherein the secondary implement is readily retractable within and extensible from the cap by simple manual operations, and wherein the implement, when extended, is conveniently positioned for manipulation with the dispenser employed as the handle for the implement.

Yet another object is to provide such a dispenser for mascara, wherein the secondary implement is an eyelash-separating comb, the dispenser being of conventional shape and dimensions.

Additional objects of the invention are to provide a cap and applicator unit for such a dispenser, including a retractable and extensible implement, and to provide a mascara package including such a dispenser and a quantity of mascara contained therein.

To these and other ends, the present invention in a first aspect broadly contemplates the provision of a dispenser for a material to be applied manually to a substrate, comprising a container for the material, having an opening; a hollow cap having a distal end removably mountable on the opening and an open proximal end; an applicator for the material, carried by the cap and projecting from the distal end thereof for insertion into the opening; an implement receivable within the open proximal end of the cap and extendable therefrom in a proximal direction to assist in application of the material; a member extending distally from the implement lengthwise within the cap; the cap including a portion within which the implement and stem are moveable; the cap further including an element, manually movable relative to the last-mentioned cap portion, and pivotally connected to the member within the cap so as to move the member to displace the implement lengthwise of the cap between a retracted position within the proximal end of the cap and an extended position outside the cap, the member having an axis of pivotal motion; and a guide within the cap, engaging the member, the member having a guide-engaging portion so shaped and disposed, in relation to the guide and the axis of pivotal motion, that as the member is moved by the element to displace the implement from the retracted position to the extended position, the guide pivotally tilts the member to dispose the implement in offset relation to the cap.

In certain embodiments, the aforementioned cap portion and element are, respectively, proximally and distally disposed parts of a hollow cap shell interconnected for rotation relative to each other about a common long axis; the cap further includes a swivel having an internally threaded transverse bore and mounted within the hollow shell on the proximal end of the element for pivotal movement about an axis perpendicular to the common long axis; the stem is externally threaded and extends through the bore in threaded engagement therewith such that relative rotation of the swivel and stem causes lengthwise movement of the stem; and the cap portion defines a slot, through which the stem extends, dimensioned to prevent rotation of the stem about the common long axis relative to the aforementioned cap portion.

More particularly, in currently preferred embodiments of the invention, a dispenser for a material to be applied manually to a substrate comprises a container for the material, having an opening; a hollow cap having a distal end removably mountable on the opening and an open proximal end; an applicator for the material, carried by the cap and projecting from the distal end thereof for insertion into the opening; an implement receivable within the open proximal end of the cap and extendable therefrom in a proximal direction to assist in application of the material; a member extending distally from the implement lengthwise within the cap; a manually accessible and movable button on the exterior of the cap, pivotally connected to the member within the cap so as to move the member to displace the implement lengthwise of the cap between a retracted position within the proximal end of the cap and an extended position outside the cap, the member having an axis of pivotal motion; and a fixed guide within the cap, engaging the member, the member having a guide-engaging portion so shaped and disposed, in relation to the guide and the axis of pivotal motion, that as the member is moved by the button to displace the implement from the retracted position to the extended position, the guide pivotally tilts the member to dispose the implement in offset relation to the cap.

The terms "distal" and "proximal" as used herein are defined by the convention that the applicator is at the distal end of the cap and the cap is at the proximal end of the applicator.

As a particular feature of the invention, in preferred embodiments thereof, the button is slidable lengthwise of the cap, the cap has a longitudinal slot, and the button is connected to the member through the slot. Conveniently the button and member are connected by structure including an element disposed in the slot, which has closed extremities engageable with the element to limit the movement of the button and member. Thus, the button may be connected by such an element to a yoke within the cap and the member may be pivotally mounted on the yoke.

Also conveniently or preferably, the member comprises a shaft having a central portion with opposed straight sides and terminating distally in a dogleg with opposed straight sides, the central portion and the dogleg forming an oblique angle with a vertex coincident with the axis of pivotal motion. In addition, the implement, which may be a comb, advantageously has an angular orientation relative to the member such that, when the implement is in offset relation to the cap as aforesaid, it is substantially parallel to the long axis of the cap. The implement may be formed integrally with the member, e.g. as a unitary rigid molded plastic component.

The container opening may be an externally threaded neck and, in such case, the distal portion of the cap comprises an internally threaded skirt engageable with the neck, the skirt laterally surrounding the applicator in spaced relation thereto.

In embodiments of the invention for use as dispensers for mascara, the applicator is an applicator for conveying mascara from the container to a user's eyelashes, and the implement is a comb for separating eyelashes.

The invention in further aspects embraces a mascara package comprising a dispenser as described above and a body of mascara in the container; and a cap and applicator unit for such a dispenser, including the cap, applicator, implement, member, button and guide described above.

As embodied in a mascara package, the invention affords a dispenser configured in a manner that duplicates the normal consumer-accepted mascara package design, and (like conventional mascara dispensers) affords a mascara fluid reservoir and a means of application. The dispenser of the invention incorporates into the cap a lash separator comb that is normally enclosed and hidden. After the user has applied the mascara and replaced the cap, the comb can be extended by sliding a button on the side of the cap. The comb emerges and projects through the top or proximal end of the cap. At the end of the comb-extending stroke, the comb tilts so that it is clear of the relatively massive dispenser. This facilitates the delicate procedure of eyelash separation, using the dispenser itself as the handle for manipulating the comb. After use, the comb is retracted and stored within the cap, being thereby shielded. It cannot become lost or misplaced, because it is at all times connected to the cap.

Further features and advantages of the invention will be apparent from the detailed description hereinafter set forth, together with the accompanying drawings.

DETAILED DESCRIPTION

The invention will be described, with reference to the accompanying drawings, as embodied in a mascara dispenser 10 including an elongated, axially rectilinear, generally cylindrical container 11 and an elongated, axially rectilinear, generally cylindrical cap 12. In the form shown, the container and cap have the same external diameter, so that when they are assembled together (FIG. 1) they constitute an extended continuous cylindrical body in which the container and the cap each occupies about half the length of the visible external surface.

Figure 3:
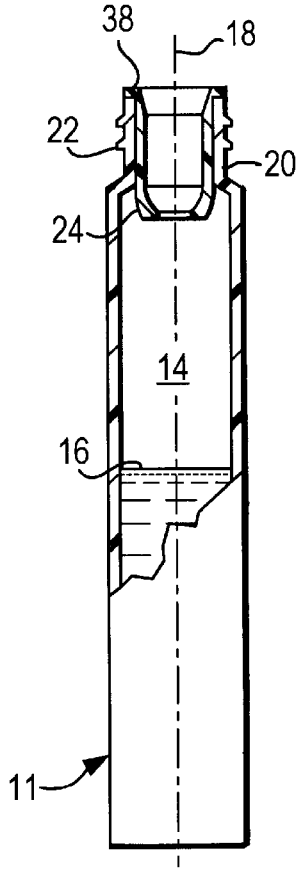
FIG. 3 is a similarly enlarged side elevational view, also partly in section, of the container of the FIG. 1 dispenser.

The container 11 is a rigid molded plastic component defining a reservoir 14 holding a quantity of liquid mascara 16 (FIG. 3) and has an opening 18 at one end, the end portion of the container adjacent this opening being formed as a neck 20 with an external thread 22. Within the neck is disposed a flexible annular plastic wiper element 24, e.g. a wiper element of a type conventional for mascara dispensers.

The cap 12 includes a generally cylindrical hollow outer shell 26 (which may, for example, be either a metal or a molded plastic component) and a molded plastic insert 28. The insert 28 has a transverse septum 30 disposed adjacent but inwardly of the distal end 32 of the cap, a stem 34 projecting distally from the septum (along the long geometric axis 35 of the cap) through and beyond the distal end of the cap, and an internally threaded (and distally open) skirt portion 36 extending along the inner surface of the shell to the cap distal end in concentric, surrounding, spaced relation to the proximal portion of the stem. The shell 26 is fixedly bonded to the insert 28 in surrounding coaxial relation thereto.

The skirt is dimensioned to engage the thread 22 of the container neck 20 when the cap is placed on the neck, thereby to securely close the container opening 18. An outwardly projecting annular flange or lip 38 of the wiper 24 overlies the rim of the container neck for engaging the interior of the skirt 38 and/or the septum 32 when the cap is fully screwed on the neck; this flange serves as a gasket to prevent leakage of liquid from the container while the cap is seated on the neck.

Figure 2:
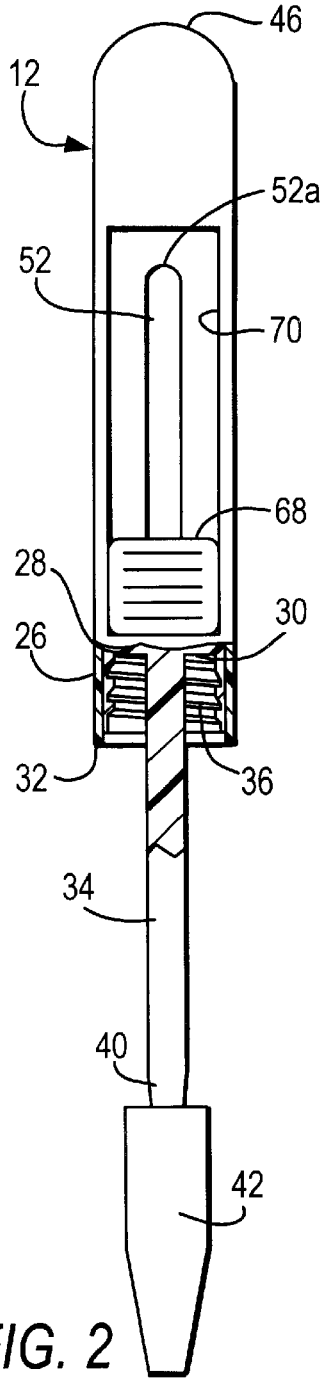
FIG. 2 is an enlarged side elevational view, partly in section, of the cap and applicator unit of the mascara dispenser of FIG. 1, with the comb retracted.

The stem 34 has a free distal end 40 at which an applicator element such as a conventional twisted-in-wire mascara brush 42 (FIG. 2) is mounted in coaxial relation to the stem. The length of the stem and brush are such that, when the cap is seated on the container neck, the brush extends down into the lowest portion of the container reservoir, and is immersed in the contained liquid mascara 16 therein.

The features of the mascara dispenser 10 and its components as thus far described are generally conventional in structure, fabrication and use. In accordance with the present invention, the dispenser is also provided with a comb 44 carried by the cap 12 and capable of being extended out of the proximal end 46 of the cap or retracted within the cap. To this end, the cap (i.e., the shell 26) is open at the proximal end 46, defining a recess or well 48 into which the comb can be retracted and having an end aperture 50 (e.g. in the form of a slit) through which the comb can be extended. The shell also has an elongated slot 52 that extends, parallel to the geometric axis 35 of the cap, along a side of the shell for part of the distance between the proximal and distal ends of the cap and has closed extremities 52*a* and 52*b*.

Disposed within the cap is a member in the form of a rigid integral shaft 54 dimensioned to fit within the cap and including an elongated, rectilinear, straight-sided central portion 56, a proximal portion comprising the comb 44 extending at an oblique angle to the central portion, and a straight-sided distal portion comprising a dogleg 58 extending at an equal but oppositely opening oblique angle to the central portion, the vertex of the last-mentioned oblique angle being indicated at 60. The shaft 54 is movable lengthwise of the cap between an extended position (FIGS. 1, 6, 7) in which the comb 44 and the central portion 56 project beyond the proximal end 46 of the cap and a retracted position (FIGS. 2, 4, 5) entirely within the cap. Also disposed within the cap, for sliding movement therein parallel to the geometric axis of the cap, is a rigid yoke 62 having a proximal nose portion 64 carrying a pivot 66 on which the shaft 54 is mounted at the vertex point 60 between the central portion and the dogleg of the shaft. The shaft 54 is rotatable on the pivot 66, relative to the yoke and cap, about an axis perpendicular to the axis 35 of the cap.

A manually engageable slide or button 68 is disposed outwardly of and is movable along the slot 52, being (for example) seated in a recessed external slideway 70 formed in the side wall of the shell 26 in surrounding relation to the slot 52. The inner surface of the button 68 is fixedly secured to a distal portion of the yoke 62 by means of an element such as a stud or post 72 that rides in and projects through the slot 52, so that movement of the button 68 lengthwise along the exterior of the cap produces corresponding movement of the yoke within the cap, and of the shaft 54 which is connected by the pivot to the yoke. The post 72 is positioned sufficiently distally of the pivot 66 to provide clearance for unhindered rotation of the dogleg 58 about the pivot, as will be clear from FIGS. 5 and 6. The closed extremities 52*a* and 52*b* of the slot are engageable with the post 72 to limit the movement of the slide and shaft.

Figure 5:
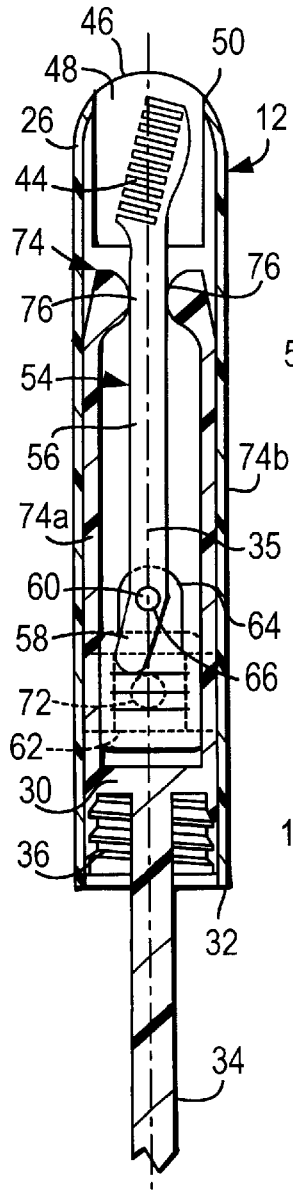
FIGS. 4 and 5 are, respectively, a further enlarged side elevational view and a similarly enlarged side sectional view of the cap of FIG. 2, with the comb retracted.
Figure 4:
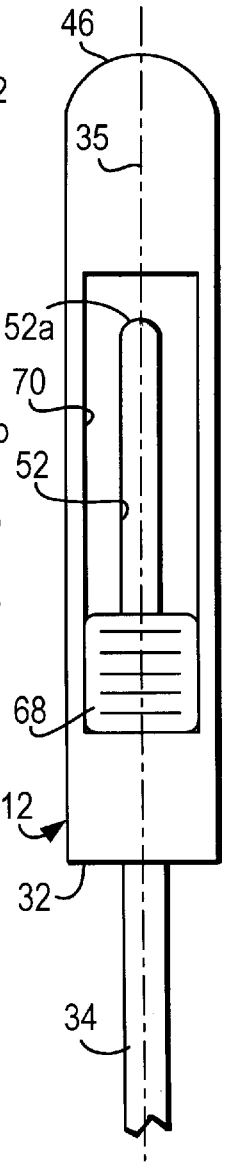
Figure 10:
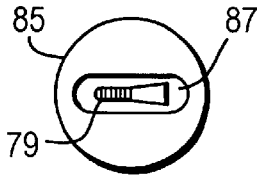
FIG. 10 is an end view of the proximal extremity of the cap of FIGS. 8 and 9.
Figure 11:
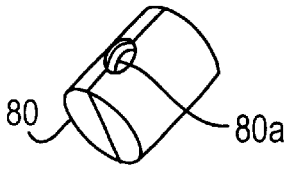
FIG. 11 is a perspective view of the swivel element included in the embodiment of FIGS. 8 and 9.
Figure 12:
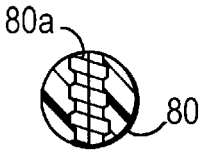
FIG. 12 is a cross sectional view of the swivel of FIG. 11.
Figure 8:
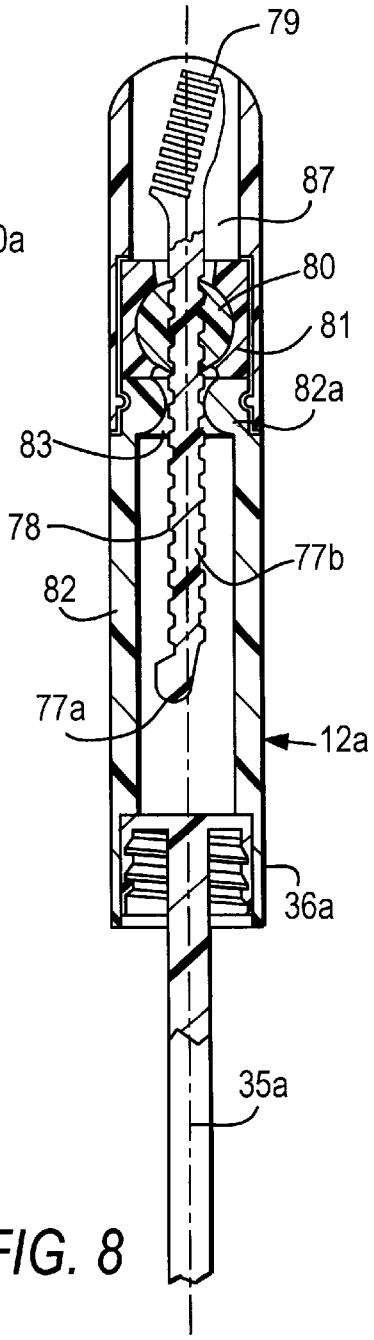
FIGS. 8 and 9 are somewhat enlarged side sectional views of the cap of another embodiment of the dispenser of the invention, respectively showing the comb in retracted and extended positions.
Figure 9:
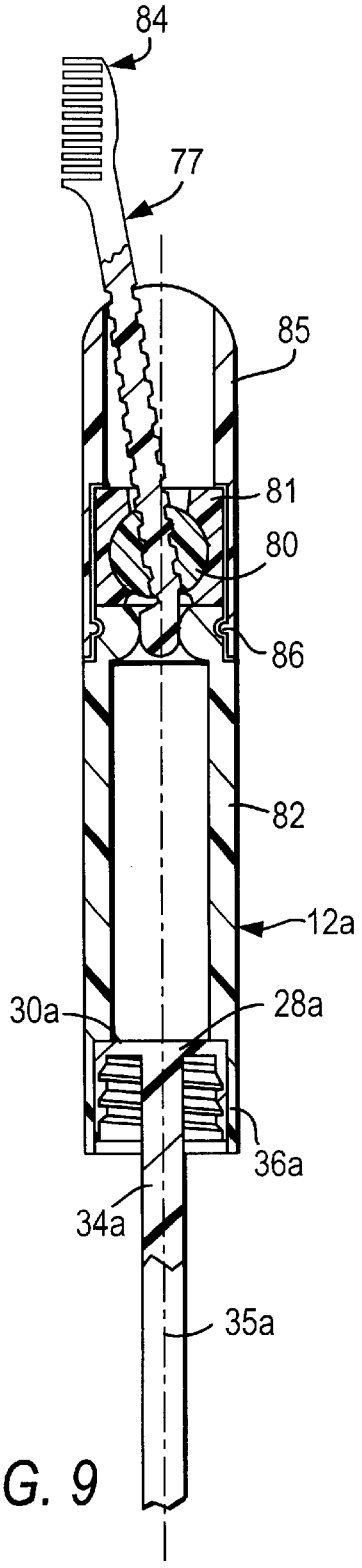

A guide structure 74, in the form of a pair of fingers 74*a* and 74*b* molded as an integral part of the insert 28 and extending in a proximal direction from the septum 30 along opposite side wall portions of the shell 26, terminates in a pair of opposed projections 76 fixedly positioned within and adjacent the proximal end of the cap but inwardly of the well 48. These projections respectively engage the opposite straight sides of the shaft central portion 56, as seen in FIG. 5, when the comb and shaft are in fully retracted position entirely enclosed by the cap, and the button 68 is at the distal extremity of its path of movement (FIG. 4).

Figure 1:
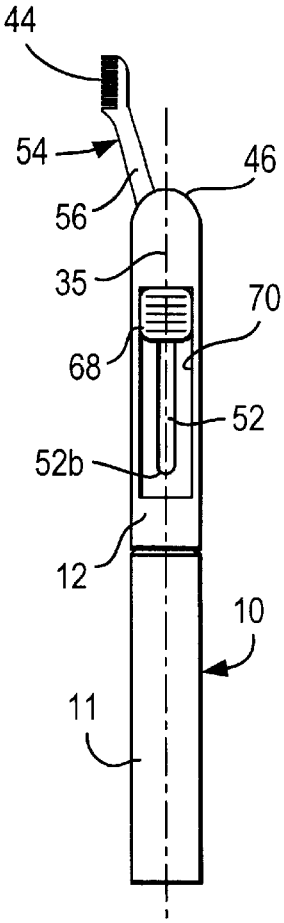
FIG. 1 is a side elevational view of a mascara dispenser embodying the present invention in a particular form, with the lash-separating comb shown in fully extended position, ready for use.
Figure 7:
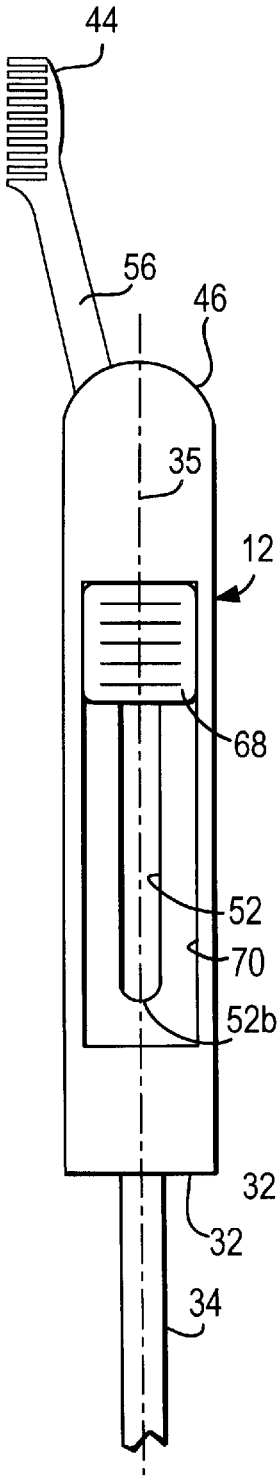
FIGS. 6 and 7 are views of the cap of FIG. 2, respectively corresponding to FIGS. 5 and 4 but with the comb extended.
Figure 6:
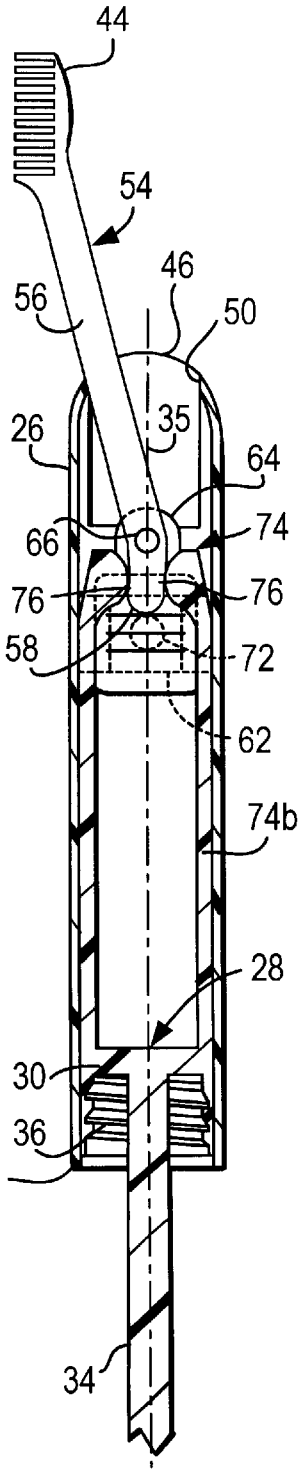

When the button is pushed manually along the cap exterior in a proximal direction to extend the comb, moving the yoke and shaft, the opposed straight sides of the shaft central portion initially move in sliding engagement with the respective fixed guide projections 76. Thereby, the shaft is held against pivotal movement and its central portion remains axially aligned with the cap. As continued proximally directed movement of the shaft carries the pivot 66 at the vertex 60 past the guide projections, however, the two guide projections respectively come into engagement with the opposed straight sides of the dogleg 58 which, as stated, is oriented at an oblique angle to the central portion. The engagement of the guide projections with the obliquely angled dogleg causes the shaft to pivot about vertex 60, rotating the shaft central portion out of alignment with the cap axis and concomitantly aligning the dogleg with the cap axis, i.e., tilting the comb relative to that axis so that, at the fully extended position, the comb is offset with respect to the cap as FIGS. 1, 6 and 7 show.

Owing to the oblique angling of the comb relative to the shaft central portion, the comb and dogleg extend parallel to each other. Hence, in the fully extended position, the comb though offset relative to the cap has its long dimension oriented in parallel relation to the axis of the cap.

The use of the described dispenser will now be readily apparent. Typically, the dispenser is sold as a mascara package, i.e., with the container filled with mascara 16. To apply mascara, the consumer unscrews and removes the cap, withdrawing the applicator (including the stem and the mascara brush) from the container interior or reservoir. As the brush is thus withdrawn, it carries mascara from the reservoir; excess mascara is wiped from the brush by the wiper element.

Employing the cap as a handle, the consumer manipulates the brush to apply mascara therefrom to the eyelashes. This procedure delivers a desired amount of mascara to the lashes, but the deposited mascara may cause the lashes to clump or stick together.

When the delivery of mascara to the lashes is completed, the cap is replaced on the container neck and screwed tight to close the container against leakage of liquid. Until this point, the comb 44 has been completely retracted within the cap, i.e., in the position best seen in FIG. 5. Now, the consumer pushes the button 68 manually in a proximal direction along the slot 52, causing the shaft 54 to slide in the same direction within the shaft, so that the comb emerges through aperture 50 and projects progressively further out of the proximal end of the cap. As the comb approaches full extension, the dogleg portion of the shaft encounters the guide projections within the hollow cap, tilting the central shaft portion out of alignment with the cap axis and ultimately positioning the fully extended comb in the offset but parallel relation to the cap shown e.g. in FIG. 7.

Using the complete assembled dispenser (cap and container) as a handle, the consumer manipulates the comb to separate the eyelashes. The offset position of the comb, and its angular orientation relative to the dispenser, are important in enabling easy and successful performance of the delicate lash-combing operation. If the comb were not thus offset, the massive body of the dispenser would tend to interfere with needed manipulative freedom.

After the lashes have been separated, the consumer returns the comb to its retracted position within the cap by manually pushing the button back along the slot 52 until the post 72 is arrested by the distal extremity of the slot. The comb then remains stored in and shielded by the cap until it is needed at the next application of mascara. It cannot become misplaced, since it is permanently connected to the cap, which both protects it and prevents it from soiling objects or surfaces outside the dispenser.

FIGS. 8–12 illustrate the cap 12*a* of another dispenser (e.g. for mascara) embodying the invention. To constitute a complete dispenser, the cap 12*a* may be combined, for example, with the container 11 of FIGS. 1 and 3. The cap 12*a* has an elongated and generally cylindrical hollow shell, described below; fixedly bonded thereto is a molded plastic insert 28*a* including a transverse septum 30*a* disposed adjacent but inwardly of the distal end of the cap, a stem 34*a* projecting distally from the septum (along the long geometric axis 35*a* of the cap) through and beyond the distal end of the cap, and an internally threaded and distally open skirt portion 36*a* extending to the cap distal end in surrounding spaced relation to the stem for engaging a threaded container neck. Also in common with the first-described embodiment, the stem 34*a* has a free distal end bearing an applicator such as a mascara brush (not shown).

The cap 12*a,* like the cap 12 of FIGS. 1–7, carries a comb which is formed integrally with and at the proximal end of a rigid stem or shaft member or stem 77 and is capable of being extended out of the proximal end of the cap and tilted, or retracted within the cap, by movement of the stem relative to the cap. However, in the embodiment of FIGS. 8–12 the mechanism for comb extension and tilting, unlike that in FIGS. 1–7, is a jackscrew and swivel arrangement.

More particularly, in this embodiment, the stem is configured with a dogleg 77*a* at its distal end similar to the first described embodiment, but has a screw thread 78 along its elongated rectilinear central portion 77*b* between the dogleg and the comb itself, which is designated 79. The threaded stem is provided with two opposing flats along its entire length so that the thickness of the comb 79 and that of the stem central portion 77*b* are equal or nearly equal.

A cylindrical swivel 80 formed in two halves and having a transverse central bore 80*a* with a female thread countersunk at each end, receives the threaded central portion 77*b* of the stem within the bore such that the stem is sandwiched between the two halves of the swivel and the screw thread 78 of the stem mates with the female thread of the swivel bore. This three-piece assembly is in turn snapped into a swivel holder 81 which is mounted on the proximal end of a distal portion 82 of the cap and is locked in place by means of a friction fit between a molded-in post-and- hole or other locking arrangement (not shown) so that the swivel holder cannot rotate, relative to cap portion 82, about the cap axis 35*a,* although the swivel itself can pivot, relative to the swivel holder and cap, about an axis perpendicular to axis 35*a* and to the axis of the bore 80*a.*

The hollow shell of the cap 12*a* is formed in two separate parts, 82 and 85, disposed in tandem along axis 35*a* and interconnected for rotation, relative to each other, about axis 35*a*. The distal part of the shell is a cylinder 82 open at its distal end and partially closed at its proximal end, which has a reduced inside diameter opening configured as a torus 82*a* to define a radiused opening 83 sized to allow the comb stem 77 to side through and also to function as a stem guide.

For assembly, with the comb 79 extended to its tilt position 84, the proximal part 85 of the shell is placed over the comb and snapped over the cam-shaped or toroidal proximal end 82*a* of the distal shell part 82. The shell part 85 is retained thereon by a bead and groove arrangement 86 that allows for relative rotary motion between the shell part 85 and the remainder of the dispenser. The shell part 85 is slotted along its entire length, as shown at 87. The purpose of the slot 87, which opens through the proximal end of shell part 85 so that the comb can be extended outwardly therethrough (see FIGS. 9 and 10), is to restrict angular displacement of the comb 79 and its stem 77 relative to the shell part 85.

The assembled dispenser is delivered to the user with the comb in rest position. That is, the comb is fully retracted inside the cap. To extend and tilt the comb the user rotates the main body of the dispenser (i.e., the container and the shell part 82 secured thereto by the skirt 36*a*) while holding the shell part 85 stationary, or rotates the shell part 85 relative to the main body of the dispenser.

More particularly, in this embodiment, relative rotation of the shell parts 82 and 85 about axis 35*a* causes the swivel 80 to rotate about axis 35*a* relative to the slot 87 in shell part 85, because the swivel and its holder 81 are secured against rotation about axis 35*a* relative to the shell part 82. The comb 79 and its stem or shaft member 77, however, are prevented from rotation relative to the shell part 85 by the side walls of the slot 87, so that the stem 77 turns within the swivel bore 80*a*. Consequently, by virtue of the engagement of the stem thread 78 with the thread of the bore 80*a,* such relative rotation of the shell parts 82 and 85 effects longitudinal movement of the stem, along the cap axis 35*a,* to extend or retract the comb depending on the direction of rotation.

The toroidal portion 82*a* of shell part 82, functioning as a guide for the comb stem (similarly to the guide projections 76 of FIGS. 1–7) hold the stem in alignment with axis 35*a* as long as the central portion 77*b* of the stem is passing through the opening 83. However, when the distal dogleg 77*a* of the stem reaches opening 83, portion 82*a* tilts the stem, which pivots (along with swivel 80) about the transversely oriented geometric axis of the swivel, cylindrical swivel 80 pivots about its geometric axis, thereby moving the extended comb 79 to the offset position shown in FIG. 9. The dogleg is dimensioned, in relation to the bore 80*a,* to act as a stop limiting outward (extended) movement of the comb and stem.

It is to be understood that the invention is not limited to the features and embodiments hereinabove specifically set forth, but may be carried out in other ways without departure from its spirit.

What is claimed is:

1. A dispenser for a material to be applied manually to a substrate, comprising:

(a) a container for the material, having an opening;

(b) a hollow cap having a distal end removably mountable on the opening and an open proximal end;

(c) an applicator for the material, carried by the cap and projecting from the distal end thereof for insertion into the opening;

(d) an implement receivable within the open proximal end of the cap and extendable therefrom in a proximal direction to assist in application of the material;

(e) a member extending distally from the implement lengthwise within the cap;

(f) said cap including a portion within which said implement and member are moveable;

(g) said cap further including an element, manually movable relative to said last-mentioned cap portion, and pivotally connected to the member within the cap so as to move the member to displace the implement lengthwise of the cap between a retracted position within the proximal end of the cap and an extended position outside the cap, the member having an axis of pivotal motion; and (g) a guide within the cap, engaging the member, the member having a guide-engaging portion so shaped and disposed, in relation to the guide and the axis of pivotal motion, that as the member is moved by the element to displace the implement from the retracted position to the extended position, the guide pivotally tilts the member to dispose the implement in offset relation to the cap.

2. A dispenser as defined in claim 1, wherein said cap portion and said element are, respectively, proximally and distally disposed parts of a hollow cap shell interconnected for rotation relative to each other about a common long axis; wherein said cap further includes a swivel having an internally threaded transverse bore and mounted within the hollow shell on the proximal end of said element for pivotal movement about an axis perpendicular to said common long axis; wherein said member is externally threaded and extends through said bore in threaded engagement therewith such that relative rotation of the swivel and member causes lengthwise movement of the member; and wherein said cap portion defines a slot, through which the member extends, dimensioned to prevent rotation of the stem about said long axis relative to said cap portion.

3. A dispenser as defined in claim 1, wherein said element is a manually accessible and movable button on the exterior of the cap, and pivotally connected to the member within the cap as aforesaid.

4. A dispenser for a material to be applied manually to a substrate, comprising:

(a) a container for the material, having an opening;

(b) a hollow cap having a distal end removably mountable on the opening and an open proximal end;

(c) an applicator for the material, carried by the cap and projecting from the distal end thereof for insertion into the opening;

(d) an implement receivable within the open proximal end of the cap and extendable therefrom in a proximal direction to assist in application of the material;

(e) a member extending distally from the implement lengthwise within the cap;

(f) a manually accessible and movable button on the exterior of the cap, pivotally connected to the member within the cap so as to move the member to displace the implement lengthwise of the cap between a retracted position within the proximal end of the cap and an extended position outside the cap, the member having an axis of pivotal motion; and (g) a fixed guide within the cap, engaging the member, the member having a guide-engaging portion so shaped and disposed, in relation to the guide and the axis of pivotal motion, that as the member is moved by the button to displace the implement from the retracted position to the extended position, the guide pivotally tilts the member to dispose the implement in offset relation to the cap.

5. A dispenser as defined in claim 4, wherein the button is slidable lengthwise of the cap, wherein the cap has a longitudinal slot, and wherein the button is connected to the member through the slot.

6. A dispenser as defined in claim 5, wherein the button and member are connected by structure including an element disposed in the slot and the slot has closed extremities engageable with the element to limit the movement of the button and member.

7. A dispenser as defined in claim 5, further including a yoke slidably disposed within the cap, wherein the button is connected by said element to the yoke and wherein the member is pivotally mounted on the yoke.

8. A dispenser as defined in claim 4, wherein the member comprises a shaft having a central portion with opposed straight sides and terminating distally in a dogleg with opposed straight sides, the central portion and the dogleg forming an oblique angle with a vertex coincident with the axis of pivotal motion.

9. A dispenser as defined in claim 4, wherein the cap has a long axis and the implement has an angular orientation relative to the member such that, when the implement is in offset relation to the cap as aforesaid, it is substantially parallel to the long axis of the cap.

10. A dispenser as defined in claim 9, wherein the implement is a comb and is formed integrally with the member.

11. A dispenser as defined in claim 4, wherein the material is mascara, the applicator is an applicator for conveying mascara from the container to a user's eyelashes, and the implement is a comb for eyelashes.

12. A dispenser as defined in claim 4, wherein the opening comprises an externally threaded neck and wherein the distal portion of the cap comprises an internally threaded skirt engageable with the neck, the skirt laterally surrounding the applicator in spaced relation thereto.

13. A mascara package comprising a dispenser as defined in claim 4 and a body of mascara in the container.

14. A cap and applicator unit for a dispenser for a material to be applied manually to a substrate, said dispenser including a container for the material, said container having an opening, said cap and applicator unit comprising:

(a) a hollow cap having a distal end removably mountable on the container opening and an open proximal end;

(b) an applicator for the material, carried by the cap and projecting from the distal end thereof for insertion into the opening;

(c) an implement receivable within the open proximal end of the cap and extendable therefrom in a proximal direction to assist in application of the material;

(d) a member extending distally from the implement lengthwise within the cap;

(e) a manually accessible and movable button on the exterior of the cap, pivotally connected to the member within the cap so as to move the member to displace the implement lengthwise of the cap between a retracted position within the proximal end of the cap and an extended position outside the cap, the member having an axis of pivotal motion; and (f) a fixed guide within the cap, engaging the member, the member having a guide-engaging portion so shaped and disposed, in relation to the guide and the axis of pivotal motion, that as the member is moved by the button to displace the implement from the retracted position to the extended position, the guide pivotally tilts the member to dispose the implement in offset relation to the cap.

* * * * *